US008999902B2

(12) United States Patent
Abe

(10) Patent No.: US 8,999,902 B2
(45) Date of Patent: Apr. 7, 2015

(54) ENGINE OIL ADDITIVE, ENGINE OIL AND METHOD OF ADDITION THEREOF

(75) Inventor: Toshinori Abe, Toyonaka (JP)

(73) Assignee: T.M.C. Company, Limited, Toyonaka-shi (JP)

( * ) Notice: Subject to any disclaimer, the term of this patent is extended or adjusted under 35 U.S.C. 154(b) by 277 days.

(21) Appl. No.: 13/510,112

(22) PCT Filed: Aug. 24, 2010

(86) PCT No.: PCT/JP2010/064269

§ 371 (c)(1), (2), (4) Date: May 16, 2012

(87) PCT Pub. No.: WO2011/061979

PCT Pub. Date: May 26, 2011

(65) Prior Publication Data

US 2012/0231983 A1 Sep. 13, 2012

(30) Foreign Application Priority Data

Nov. 20, 2009 (JP) ..... 2009-264732

(51) Int. Cl.

*C10M 125/04* (2006.01)
*C10M 125/00* (2006.01)
*C10M 169/04* (2006.01)

(52) U.S. Cl.

CPC ..... *C10M 125/00* (2013.01); *C10N 2230/02* (2013.01); *C10N 2250/12* (2013.01); *C10M 125/04* (2013.01); *C10M 2201/04* (2013.01); *C10M 2201/05* (2013.01); *C10M 2203/1006* (2013.01); *C10M 2205/173* (2013.01); *C10N 2220/082* (2013.01); *C10N 2230/06* (2013.01); *C10N 2230/54* (2013.01); *C10N 2240/10* (2013.01); *Y10S 977/81* (2013.01)

(58) Field of Classification Search

USPC ..... 508/150; 977/810
See application file for complete search history.

(56) References Cited

U.S. PATENT DOCUMENTS

2008/0312111 A1 12/2008 Malshe et al.

FOREIGN PATENT DOCUMENTS

| | | | | |
|---|---|---|---|---|
| JP | 61-059622 | A | | 3/1986 |
| JP | 11-106806 | A | | 4/1999 |
| JP | 2005-098470 | A | | 4/2005 |
| JP | 2006-008954 | A | | 1/2006 |
| JP | 2006008954 | A | * | 1/2006 |
| JP | 2006-111903 | A | | 4/2006 |
| JP | 2009-523863 | A | | 6/2009 |
| WO | WO-2006/001427 | A1 | | 1/2006 |

OTHER PUBLICATIONS

Wang, A., Yin, H., Ren, M., Liu, Y., Jiang, T., "Synergistic effect of silver seeds and organic modifiers on the morphology evolution mechanism of silver nanoparticles", Applied Surface Science, 254(20), 2008, 6527-6536.*

Pietrobon, B., McEachran, M., Kitaev, V., "Synthesis of Size-Controlled Faceted Pentagonal Silver Nanorods with Tunable Plasmonic Properties and Self-Assembly of These Nanorods", ACS NANO, 3(1), 2009, 21-26.*

Aili Wang et al., "Synergistic effect of silver seeds and organic modifiers on the morphology evolution mechanism of silver nanoparticles," Applied Surface Science, vol. 254, No. 20, Aug. 15, 2008, pp. 6527-6536.

Brendan Pietrobon et al. "Synthesis of Size-Controlled Faceted Pentagonal Silver Nanorods with Tunable Plasmonic Properties and Self-Assembly of These Nanorods," ACS NANO, vol. 3, No. 1, Jan. 27, 2009, pp. 21-26.

Supplementary European Search Report dated Mar. 14, 2013, issued for the corresponding European patent application No. 10831378.4.

International Search Report dated Nov. 9, 2010, issued for PCT/JP2010/064269.

* cited by examiner

*Primary Examiner* — James Goloboy

(74) *Attorney, Agent, or Firm* — Locke Lord LLP; James E. Armstrong, IV; Nicholas J. DiCeglie, Jr.

(57) ABSTRACT

The engine oil additive contains multiple 300 to 500 nm-long polygonal plate-shaped silver crystal particles. The engine oil contains a base oil and the engine oil additive. The method of adding the additive to an engine oil includes adding multiple 300 to 500-nm-long polygonal plate-shaped silver crystal particles as an additive to the engine oil.

13 Claims, No Drawings

ENGINE OIL ADDITIVE, ENGINE OIL AND METHOD OF ADDITION THEREOF

TECHNICAL FIELD

The present invention relates to an engine oil additives to be added to an engine oil used for motor vehicles, constructing machine and the like, an engine oil supplemented with the engine oil additive and the method of adding the additive to an engine oil.

BACKGROUND ART

Solid lubricants are generally added to an engine oil in order to improve its lubricating performance. For example, Patent Document 1 disclosed a lubricating treatment for engines using a composition containing a solid lubricant and an organic medium.

Specific examples of solid lubricants are described in Patent Document 1, including molybdenum disulfide, tungsten disulfide, graphite, polytetrafluoroethylene, boron nitride, soft metals (e.g., silver, lead, nickel, copper), cerium fluoride, zinc oxide, silver sulfate, cadmium iodide, lead iodide, barium fluoride, tin sulfide, zinc phosphate, zinc sulfide, mica, boron nitrate, boric acid, fluorocarbon, zinc phosphide and boron.

In order to disperse such a solid lubricant, e.g. a solid lubricant containing a mixture of molybdenum disulfide, copper, silver and lead, in an engine oil, first the solid lubricant is ball milled into fine powder in the air or in the vacuum. Subsequently the finely-milled mixture is ball-milled in a vegetable oil (canola oil), to which an emulsifier is then added, to add to the engine oil.

Adding solid lubricants to an engine oil in this manner results in an enhancement of lubricating performance of the engine oil, allowing engine torque and horsepower to be improved.

PRIOR ART DOCUMENT

Patent Document

[Patent Document 1]: JP 2009-52863A

SUMMARY OF INVENTION

Problems to be Solved by the Invention

However, solid lubricants dispersed in engine oil via the steps described above accumulate in or adhere to asperities on metal surfaces of machinery parts constituting an engine too poorly to substantially enhance a lubricating performance of an engine oil. Thus, adding solid lubricants to an engine oil via the steps above had little effect to improve engine torque and horsepower.

In view of such a situation for engine oil additives, the objective of the present invention is to provide an engine oil additive producing a great effect of enhancing a lubricating performance of an engine oil, and an engine oil containing the engine oil additive.

In addition, the present invention is also aimed to provide the method of adding the additives to enhance a lubricating performance of an engine oil.

Means for Solving the Problems

As a result of careful consideration on above mentioned problems, the inventors have found that 300 to 500-nm-long polygonal plate-shaped silver crystal particles readily accumulate in or adhere to asperities on metal surfaces of machinery parts constituting an engine and is easy to disperse in an engine oil.

The engine oil additive according to the present invention is an engine oil additive containing multiple polygonal plate-shaped silver crystal particles, wherein all of the silver crystal particles contained in the engine oil additive have a length of 300 to 500 nm.

According to this composition, the engine oil additive contains silver crystal particles with the shape and size capable of accumulating in or adhering to asperities on metal surfaces of machinery parts constituting an engine, so that the engine oil additive may provide an antifriction effect to an engine oil and, as a result, enhance its lubricating performance.

In the engine oil additive according to the invention, the silver crystal particles may be dispersed in mineral oil, chemically synthesized oil or mixed oil comprising the mineral oil and the chemically synthesized oil.

According to this composition, the engine oil additive that is easy to add to engine oil can be provided.

The engine oil according to the present invention contains a base oil and the engine oil additive according to the present invention.

According to this composition of the engine oil, the engine oil contains the engine oil additive of the invention, so that the engine oil with a good lubricating performance can be provided.

In the engine oil according to the present invention, the content of the silver crystal particles may be in the range from 0.25 to 5 g per 4 L of the engine oil.

According to this composition of the engine oil, the engine oil having a better lubricating performance can be provided.

The adding method according to the present invention, which is the method of adding multiple silver crystal particles as an additive to an engine oil, includes adding only 300 to 500-nm-long polygonal plate-shaped silver crystal particles as the silver crystal particles to the engine oil.

According to this method, the silver crystal particles with the shape and size capable of accumulating in or adhering to asperities on metal surfaces of machinery parts constituting an engine are added to an engine oil, so that a lubricating performance of the engine oil may be enhanced.

Effects of the Invention

According to the engine oil additive of the present invention, the engine oil additive contains silver crystal particles with the shape and size capable of accumulating in or adhering to asperities on metal surfaces of machinery parts constituting an engine, so that a lubricating performance of an engine oil may be improved by adding the engine oil additive to the engine oil.

According to the engine oil of the present invention, the engine oil additive of the invention is supplemented to an engine oil, so that the engine oil having a high lubricating performance may be provided.

Furthermore, according to the addition method of the present invention, the silver crystal particles with the shape and size capable of accumulating in or adhering to asperities on metal surfaces of machinery parts constituting an engine are added to an engine oil, so that a lubricating performance of the engine oil may be enhanced.

MODES FOR CARRYING OUT THE INVENTION

The present invention will be described in detail below.

The engine oil additive of the present invention contains multiple polygonal plate-shaped silver crystal particles. The 300 to 500-nm-long silver crystal particles accumulate in or adhere to asperities on metal surfaces of machinery parts constituting an engine quite well and are easy to disperse in an engine oil (base oil) compared to those with other size.

Thus, all of the silver crystal particles contained in the engine oil additive of the invention have the length from 300 to 500 nm. When using an engine oil additive containing silver crystal particles with the length less than 300 nm or more than 500 nm, the amount of silver crystal particles adhering to or accumulating in asperities on metal surfaces of machinery parts constituting an engine is too small to allow the asperities to be sufficiently smoothed out. Therefore such an engine oil additive fails to enhance a lubricating performance of an engine oil enough to allow torque and horsepower of the engine to be sufficiently improved.

The Engine oil additive of the invention described above, which is not limited to a specific form, may be in the form of a powder containing multiple 300 to 500-nm-long silver crystal particles, or may be in other forms such as a liquid, capsules and tablets discussed below.

When the engine oil additive is formulated in a liquid form, for example 300 to 500-nm-long silver crystal particles may be dispersed in mineral oil, chemically synthesized oil, or mixed oil comprising mineral oil and chemically synthesized oil. In the liquid form, in view of ease of addition to an engine oil, the content of the silver crystal particles is preferably from 0.25 to 5 g, more preferably from 0.25 to 1 g per 100 mL of mineral oil, chemically synthesized oil or mixed oil comprising mineral oil and chemically synthesized oil.

When the engine oil additive is formulated in capsules, for example the above mentioned powder or liquid formed additive may be contained in capsules. When such capsules are added to an engine oil, the capsule shells are dissolved so that the 300 to 500-nm-long silver crystal particles are dispersed in the engine oil.

Moreover, when formulating in tablets, for example the powder described above may be compressed into tablets.

The engine oil additive of the invention may be added not only to a fresh engine oil but also to an engine oil already used for driving a given distance (an engine oil being used).

The engine oil additive of the invention is added to an engine oil in an amount, without limitation, such that the content of silver crystal particles is preferably form 0.25 to 5 g and more preferably from 0.25 to 1 g per engine (about 4 L of engine oil).

When the content of silver crystal particles is less than 0.25 g per engine, which is not enough amount to allow the asperities on metal surfaces to be smoothed out, it might fail to provide a sufficient lubricating performance to an engine oil. On the other hand, when the amount of the silver crystal particles per engine is more than 5 g, the effect produced by the addition may reach a plateau and not increase anymore, which is not economically preferable.

The Engine oil additive of the invention can be applied to any kind and composition of engine oils, as well as to any commercially available engine oils containing mineral oil, chemically synthesized oil or mixed oil comprising mineral oil and chemically synthesized oil as a base oil. Among them, the engine oil having a viscosity of 0W-20, 0W-40, 0W-30 or 0W-50 is particularly suitable for an application of the engine oil additive of the invention because the silver crystal particles are easy to disperse uniformly in such an engine oil.

The engine oil additive of the invention may contain a dispersant if desired. Any dispersants capable of deflocculate the silver crystal particles can be used, preferably such as sulfonate, phenate, salicylate, phosphonate and succinimide dispersants. One of such dispersants may be used alone or alternatively two or more of them may be used together.

The engine oil of the present invention contains a base oil and the engine oil additive of the invention above. The base oil, which is not limited to the specific oil, may be selected from mineral oil, chemically synthesized oil, and mixed oil comprising mineral oil and chemically synthesized oil, each of which can be used alone or in combination each other.

The engine oil of the present invention preferably has a viscosity of 0W-20, 0W-40, 0W-30 or 0W-50, in which the silver crystal particles are easy to disperse uniformly.

The content of the silver crystal particles in the engine oil of the present invention is preferably from 0.25 to 5 g and more preferably from 0.25 to 1 g per 4 L of the engine oil. When the content of silver crystal particles is less than 0.25 g per 4 L of the engine oil, which is not enough to allow asperities on the metal surfaces to be smoothed out, it might fail to provide a sufficient lubricating performance to engine oil. On the other hand, when the amount of the silver crystal particles per 4 L of the engine oil is more than 5 g, the effect produced by the addition may reach a plateau and not increase anymore, which is not economically preferable.

The adding method of the present invention includes adding multiple 300 to 500-nm-long polygonal plate-shaped silver crystals as an additive to an engine oil. In this method, the amount of added silver crystal particles is, as with the amount of the engine oil additive according to the present invention, preferably from 0.25 to 5 g and more preferably from 0.25 to 1 g per engine (about 4 L of engine oil).

EXAMPLES

The present invention will be described in detail below with reference to examples which do not limit the present invention.

Example 1

In the engine oil additive to be used in Example 1 of the present invention, 0.25 g of 300 to 500 nm-long-polygonal plate-shaped silver crystal particles are dispersed in 100 mL of mineral oil.

Metering Experiment of Torque and Horsepower

Chassis dynamo test was performed to determine the effect of the engine oil additive of example 1 to change engine torque and horsepower. The chassis dynamo test involves mounting an automobile to a measuring equipment to measure the automobile performance such as engine speed, engine horsepower and torque. In this test, the torque and horsepower were measured at the engine speed from about 1500 to 7000 rpm using Dynapack™ (Dynos, New Zealand).

Eunos Roadster NA6CE (from MAZDA Motor Corporation) with mileage of 93188 km was subjected to the chassis dynamo test. Its engine type was B6 (four cylinder gasoline engine) and its displacement was 1597 CC. 4CR from Wako Chemical Inc. was used as an engine oil.

The result of the test performed using the engine oil with (0.25 g of the silver crystal particles) or without (non-additive) 100 mL of the engine oil additive of example 1 is shown in Table 1 below.

TABLE 1

| | Maximum torque (Nm) | Increasing rate of torque (%) | Maximum horsepower (kW) | Increasing rate of horse-power (%) |
|---|---|---|---|---|
| Non-Additive | 52.8 | — | 70.9 | — |
| Example 1 | 56.5 | 7.0 | 77.7 | 9.6 |

As shown in Table 1, it was demonstrated that the engine oil additive of example 1 had a great effect to improve torque and horsepower as compared to the additive-free engine oil. This effect is thought to be due to an antifriction property provided to engine oil by the engine oil additive of example 1, resulting in an improvement of a lubricating performance of the engine oil.

To establish that the engine oil additive of example 1 has an effect to improve engine torque and horsepower regardless of type of vehicle, that is, type of engine, the chassis dynamo test was performed as described above using BMW 135i coupe (6MT) from Bayerische Motoren Werke AG with mileage of 5965 km as a test vehicle. Its engine type was N54B30A (straight six cylinder DOHC) and its displacement was 2979 CC. The result of the test is shown in Table 2 below.

TABLE 2

| | Maximum torque (Nm) | Increasing rate of torque (%) | Maximum horsepower (kW) | Increasing rate of horse-power (%) |
|---|---|---|---|---|
| Non-Additive | 378.2 | — | 205.9 | — |
| Example 1 | 383.5 | 1.4 | 212.9 | 3.4 |

As shown in Table 2, it was also demonstrated that the engine oil additive of example 1 had an effect to improve engine torque and horsepower of BMW 135i coupe (6MT) from Bayerische Motoren Werke AG as compared to the additive-free engine oil.

Furthermore, in order to determine the durability of the effect to improve a lubricating performance of an engine oil produced by addition of the engine oil additive of example 1, a comparison test was performed to compare engine torque and horsepower between two different time points: at a time point immediately after adding the engine oil additive and at a time point after adding the additive and then driving about 2100 km. The result is shown in Table 3. In this comparison test, automobile S2000 from Honda Motor Co., Ltd. with mileage of 48124 km was used as a test vehicle. Its engine type was F20C and its displacement was 1997 CC. 4CR from Wako Chemical Inc. was used as an engine oil. 100 mL of the engine oil additive of example 1 (0.25 g of silver crystal particles) was added to the engine oil.

TABLE 3

| | Maximum torque (Nm) | Increasing rate of torque (%) | Maximum horsepower (kW) | Increasing rate of horse-power (%) |
|---|---|---|---|---|
| Non-Additive | 188.9 | — | 151.0 | — |
| Immediately after addition | 192.7 | 2.0 | 154.5 | 2.3 |
| After driving 2100 km | 196.5 | 4.0 | 159.5 | 5.6 |

As shown in Table 3, it was demonstrated that torque and horsepower measured at the time point after driving 2100 km were higher than those measured immediately after the addition. This result can be explained by the fact that as the engine oil circulates through every part inside the engine, the silver crystal particles accumulate in/adhere to asperities on metal surfaces of machinery parts constituting the engine, allowing the asperities to be smoothed out.

In order to demonstrate that the engine oil additive of the example 1 has a greater effect to improve engine torque and horsepower than conventional engine oil additives, the comparison test was performed to compare the engine torque and horsepower resulted from using the engine oil additive of the example 1 with those resulted from using a commercially available engine oil additive in which 3 to 5-nm-long silver crystal particles were dispersed (a commercial item). The result is shown in Table 4.

In this comparison test, S2000 from Honda Motor Co., Ltd. with mileage of 53500 km was subjected to the chassis dynamo test. Its engine type was FC20 and its displacement was 1997 CC. 4CR from Wako Chemical Inc. was used as an engine oil. 100 mL of the engine oil additive of example 1 or the commercially available engine oil additive was added to the engine oil.

TABLE 4

| | Maximum torque (Nm) | Increasing rate of torque (%) | Maximum horsepower (kW) | Increasing rate of horse-power (%) |
|---|---|---|---|---|
| Non-Additive | 181.6 | — | 149.1 | — |
| Example 1 | 187.7 | 3.4 | 154.2 | 3.4 |
| Commercial item | 185.2 | 2.0 | 152.6 | 2.3 |

As shown in Table 4, it was demonstrated that the engine oil additive of the example 1 exerted a greater effect to improve torque and horsepower than the commercial item. The results can be explained by the fact that the engine oil additive of the example 1 effectively provides an antifriction property to the engine oil so that its lubricating performance is highly enhanced, as compared to the commercial additive.

Fuel Consumption Testing

To determine the change of fuel consumption due to addition of the engine oil additive of the example 1, different types of cars were subjected to the test involving measurement of their fuel consumption before and after addition of the engine oil additive of the example 1. More specifically, in the test, the test cars on a tank of gasoline were subjected to driving an adequate distance, and the driving distance was then recorded, followed by calculating the driving distance per L of gasoline by dividing the recorded driving distance by the quantity of gasoline required to re-fill up the tank after the driving, and thus the fuel consumption values were determined. The result is shown in Table 5 below. The types and models of tested vehicles are as shown in Table 5 below. The engine oil used in this test had a viscosity of 0W-50. The amount of the engine oil additive of the example 1 added to the engine oil was 100 mL (0.25 g of silver crystal particles) per test car (engine).

TABLE 5

| Type | Model | Average fuel consumption before addition (km/L) | Average fuel consumption after addition (km/L) | Improvement rate of fuel consumption (%) |
|---|---|---|---|---|
| Majesty 400 | | 20.0 | 21.5 | 7.5 |
| Honda Fit | GD3 | 12.8 | 14.1 | 10.1 |
| Kawasaki ZZR400 | BC-ZXA400 N | 10.0 | 12.0 | 20.0 |

TABLE 5-continued

| Type | Model | Average fuel consumption before addition (km/L) | Average fuel consumption after addition (km/L) | Improvement rate of fuel consumption (%) |
|---|---|---|---|---|
| Skyline GTR | BNR32 | 4.9 | 7.0 | 42.8 |
| Alfa Romeo | 932BW | 6.0 | 7.6 | 26.6 |
| Nissan Stagea | WGNO34 | 5.5 | 7.9 | 43.6 |
| Nissan Cube | | 12.0 | 19.0 | 58.3 |

As shown in Table 5, the engine oil additive of the example 1 was found to be able to improve fuel consumption regardless with types and models of cars.

As shown above, it was demonstrated that the engine oil additive of the present invention according to example 1 is able to enhance a lubricating performance of an engine oil, as a result of which engine torque and horsepower as well as fuel consumption are improved.

The present invention may be practiced in other various forms without departure from the spirit and principal properties of the invention. Therefore, above mentioned examples are intended to be simply illustrative and should not be interpreted to limit the invention. The scope of the present invention should be defined with the appended claims but not with the specification in any way. Furthermore, all variations and modifications belonging to the appended claims are within the scope of the present invention.

This application claims priority to Japanese patent application 2009-264732, filed on 20 Nov. 2009, which is incorporated herein by reference in its entirety.

INDUSTRIAL APPLICABILITY

The present invention may be applied to any engine oils for automobiles, constructing machines and the like.

The invention claimed is:

1. A liquid engine oil additive comprising multiple polygonal plate-shaped silver crystal particles, wherein all of the silver crystal particles contained in the engine oil additive have a length of 300 to 500 nm, and wherein the silver crystal particles are dispersed in mineral oil, chemically synthesized oil or mixed oil comprising the mineral oil and the chemically synthesized oil.

2. An engine oil comprising a base oil and the engine oil additive according to claim 1.

3. The engine oil according to claim 2, wherein the content of the silver crystal particles is in the range from 0.25 to 5 g per 4 L of the engine oil.

4. A method of adding multiple silver crystal particles as an additive to an engine oil, comprising adding only 300 to 500-nm-long polygonal plate-shaped silver crystal particles as the silver crystal particles to the engine oil.

5. The engine oil additive according to claim 1, wherein the silver crystal particles are uniformly dispersed within the mineral oil, chemically synthesized oil or mixed oil comprising the mineral oil and the chemically synthesized oil.

6. The engine oil additive according to claim 1, wherein the content of the silver crystal particles is in the range from 0.25 to 5 g per 100 mL of the mineral oil, chemically synthesized oil or mixed oil comprising the mineral oil and the chemically synthesized oil.

7. The engine oil additive according to claim 6, wherein the content of the silver crystal particles is in the range from 0.25 to 1 g per 100 mL of the mineral oil, chemically synthesized oil or mixed oil comprising the mineral oil and the chemically synthesized oil.

8. The engine oil according to claim 2, wherein the silver crystal particles are uniformly dispersed within the engine oil.

9. The engine oil according to claim 2, wherein the content of the silver crystal particles is in the range from 0.25 to 1 g per 4 L of the engine oil.

10. The engine oil according to claim 2, wherein the viscosity of the engine oil is 0W-50.

11. The engine oil according to claim 2, wherein the viscosity of the engine oil is 0W-40.

12. The engine oil according to claim 2, wherein the viscosity of the engine oil is 0W-30.

13. The engine oil according to claim 2, wherein the viscosity of the engine oil is 0W-20.

* * * * *